US009907414B2

(12) United States Patent
Heuer

(10) Patent No.: US 9,907,414 B2
(45) Date of Patent: Mar. 6, 2018

(54) TWO COMPONENT SHELVING SYSTEM

(71) Applicant: Sonoco Development, Inc., Hartsville, SC (US)

(72) Inventor: Mark H. Heuer, Florence, KY (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 15/437,281

(22) Filed: Feb. 20, 2017

(65) Prior Publication Data

US 2017/0245661 A1 Aug. 31, 2017

Related U.S. Application Data

(60) Provisional application No. 62/299,765, filed on Feb. 25, 2016.

(51) Int. Cl.

| | |
|---|---|
| ***A47G 29/00*** | (2006.01) |
| ***A47F 5/00*** | (2006.01) |
| ***A47F 5/11*** | (2006.01) |
| ***A47B 43/00*** | (2006.01) |
| ***A47B 55/06*** | (2006.01) |
| ***A47B 96/02*** | (2006.01) |
| *A47B 47/06* | (2006.01) |

(52) U.S. Cl.

CPC ..... *A47F 5/116* (2013.01); *A47B 43/00* (2013.01); *A47B 55/06* (2013.01); *A47B 96/021* (2013.01); *A47F 5/11* (2013.01); *A47B 47/06* (2013.01)

(58) Field of Classification Search

CPC .. A47F 5/116; A47F 5/11; A47F 5/112; A47F 5/114; A47F 5/118; A47B 43/00; A47B 55/06; A47B 96/021; A47B 47/06; A47B 43/02; A47B 45/00

USPC ..... 211/135, 72, 73, 149, 186, 126.16; 248/152, 174, 346.4; 229/120.08, 120.32, 229/120.21, 120.29; 220/4.29

See application file for complete search history.

(56) References Cited

U.S. PATENT DOCUMENTS

| | | | | |
|---|---|---|---|---|
| 2,150,743 | A * | 3/1939 | Mancuso | G09F 5/00 211/135 |
| 5,042,651 | A * | 8/1991 | Davis | A47B 43/02 206/459.5 |
| 5,183,166 | A * | 2/1993 | Belokin, Jr. | A47F 5/116 211/130.1 |
| 5,213,220 | A * | 5/1993 | McBride | A47B 43/00 211/126.16 |
| 5,315,936 | A * | 5/1994 | Smith | A47F 5/116 108/165 |
| 6,105,796 | A * | 8/2000 | Buchanan | A47F 9/04 186/59 |
| 6,378,710 | B1 * | 4/2002 | Grueneberg | A47F 5/116 211/132.1 |
| 6,752,280 | B2 * | 6/2004 | Dye | A47F 5/116 108/162 |
| 7,252,200 | B1 * | 8/2007 | Hester | A47F 5/116 211/126.16 |
| 7,677,433 | B2 * | 3/2010 | Little | B65D 5/526 206/744 |

(Continued)

*Primary Examiner* — Jennifer E. Novosad

(74) *Attorney, Agent, or Firm* — Miller, Matthias & Hull LLP

(57) ABSTRACT

A two component shelving system for shipping and displaying items. The system has a plurality of shelves, with each shelf comprised of a two fold-down flaps, one from each component, connected together.

11 Claims, 11 Drawing Sheets

(56) References Cited

U.S. PATENT DOCUMENTS

| | | | | |
|---|---|---|---|---|
| 7,703,864 | B2 * | 4/2010 | Moser | B65D 5/5213 206/747 |
| 7,882,966 | B2 * | 2/2011 | Field | A47F 5/116 211/72 |
| 8,157,112 | B2 * | 4/2012 | Bojie | A47F 5/11 211/135 |
| 8,485,370 | B2 * | 7/2013 | Dewhurst | A47F 5/116 211/135 |
| 8,857,633 | B2 | 10/2014 | Dewhurst | |
| 9,474,389 | B2 * | 10/2016 | Pfeifer | A47F 5/11 |
| 9,655,446 | B2 * | 5/2017 | Brady | A47B 87/0253 |
| 9,743,783 | B1 * | 8/2017 | Bersamin | A47F 5/116 |
| 2010/0051568 | A1 * | 3/2010 | Kalwat | A47F 5/116 211/135 |
| 2016/0066711 | A1 * | 3/2016 | Mestres Armengol | A47F 5/116 211/135 |
| 2017/0079449 | A1 * | 3/2017 | Smith | A47F 5/116 |
| 2017/0245661 | A1 * | 8/2017 | Heuer | A47B 43/00 |

* cited by examiner

TWO COMPONENT SHELVING SYSTEM

BACKGROUND OF THE INVENTION

Field of the Invention

This disclosure relates to a shelving system of the kind used to display retail products. More particularly, this disclosure relates to a two component shelving system having a plurality of shelves, each shelf comprised of two fold-down flaps, one from each component, connected together.

Description of the Related Art

Corrugated shelving systems, or shelving system-like containers made primarily of corrugated board, can be used to ship items and then display the items in a retail setting. A need exists for an inexpensive corrugated shelving system that can be preassembled at the source, shipped flat, and then easily erected before being loaded with items. The present disclosure addresses this need.

BRIEF SUMMARY OF THE INVENTION

The present disclosure relates to a two component shelving system for shipping and displaying items. The system has a plurality of shelves, with each shelf comprised of a two fold-down flaps, one from each component, connected together.

In one aspect the shelving system comprises an outer structure and an inner structure. The outer structure comprises two laterally opposing first and second sidewalls, one or more elongated horizontal front panels having laterally opposing ends connected to the sidewalls along first fold lines, a rear wall integrally connected to one of the sidewalls along a second fold line and adhesively connected to the other sidewall, the rear wall defining one or more rear wall slots, and one or more shelf front flaps hingedly connected to the front panels along third fold lines, each shelf front flap comprising a tab. The inner structure comprises a pair of connecting flaps adhered to the first and second sidewalls of the outer structure, one or more elongated inner horizontal support panels having opposing ends connected the connecting flaps along sixth fold lines, and one or more shelf rear flaps hingedly connected to the elongated inner horizontal support panels along fourth fold lines. Each shelf rear flap defines a rear flap slot configured to receive the tab of a corresponding shelf front flap. Each shelf rear flap comprises a tab configured to mate with a corresponding rear wall slot. The outer structure may further comprise a vertical glue flap affixed to the rear wall along a fifth fold line.

In another aspect a two component shelving system is provided comprising an outer structure made from a first blank and an inner structure made from a second blank. The first blank comprises a plurality of front panels, a first sidewall, a second sidewall, a rear wall, a plurality of shelf front flaps and a vertical glue flap. The first sidewall is hingedly connected to the plurality of front panels along a first set of co-linear first fold lines and to the rear wall along a second fold line. The second sidewall is hingedly connected to the plurality of front panels along a second set of co-linear first fold lines and has a free vertical edge opposite the second set of co-linear first fold lines. Each front panel has two ends and is connected at either end to the sidewalls along the first and second sets of first fold lines. Each shelf front flap comprises a die cut tab located between a third fold line and a rear edge and between opposing free edges. The vertical glue flap is hingedly connected to the rear wall along a fifth fold line. The rear wall defines a plurality of horizontally oriented and vertically arranged rear wall slots. The second blank comprises a plurality of shelf rear flaps, a plurality of inner horizontal support panels and a pair of vertically elongated connecting flaps. Each inner horizontal support panel extends between and is hingedly connected to the vertically elongated connecting flaps along sixth fold lines. Each shelf rear flap is hingedly connected to an inner horizontal support panel along a fourth fold line. Each shelf rear flap defines a slot for receiving a tab from a corresponding shelf front flap. Each shelf rear flap comprises a main panel and a shelf tab hingedly connected to the main panel along a seventh fold line. Each shelf tab is configured to cooperate with a corresponding rear wall slot to lock each rear flap in a horizontal, load bearing position.

In another aspect a method of assembling a shelving system is provided comprising the steps of:

providing a first blank comprising a plurality of front panels, a first sidewall, a second sidewall, a rear wall, a plurality of shelf front flaps and a vertical glue flap, the plurality of front panels being connected to the first sidewall along a first set of co-linear first fold lines and to the second sidewall along a second set of co-linear fold first lines, the first sidewall being connected to the rear wall along a second fold line, each shelf front flap being connected to a front panel along a third fold line, each shelf front flap comprising a tab, the vertical glue flap being hingedly connected to the rear wall along a fifth fold line, the rear wall defining a plurality of rear wall slots;

providing a second blank comprising a pair of vertically elongated connecting flaps, a plurality of inner horizontal support panels hingedly connected to the vertically elongated connecting flaps along sixth fold lines, and a plurality of shelf rear flaps hingedly connected to the inner horizontal support panels along a fourth fold line; each shelf rear flap comprising a main panel defining a slot for receiving a tab from a corresponding shelf front flap and a rear flap tab hingedly connected to the main panel along a seventh fold line;

adhering one of the vertically elongated connecting flaps of second blank to the first sidewall of the first blank;

folding the first blank along the first fold lines and the second fold line;

adhering the second sidewall to the glue flaps;

rotating each shelf rear flap along a fourth fold line until each rear flap tab is inserted into a corresponding rear wall slot; and rotating each shelf front flap along a third fold line until each front flap tab is inserted into a rear flap slot.

BRIEF DESCRIPTION OF THE DRAWINGS

FIG. 4 is a front perspective view of the shelving system in an early stage of assembly.

FIG. 5 is a perspective view of the shelving system of FIG. 4 in a later stage of assembly.

FIG. 6 is a top perspective view of the shelving system of FIG. 5.

FIG. 7 is a top perspective view of the shelving system of FIG. 6 in a later stage of assembly.

FIG. 8 is a top perspective view of the shelving system of FIG. 7 in a later stage of assembly.

FIG. 9 is a side perspective view of the shelving system of FIG. 8.

FIG. 10 is a side perspective view of the shelving system of FIG. 9 in a later stage of assembly.

DETAILED DESCRIPTION OF THE INVENTION

Figure 1:
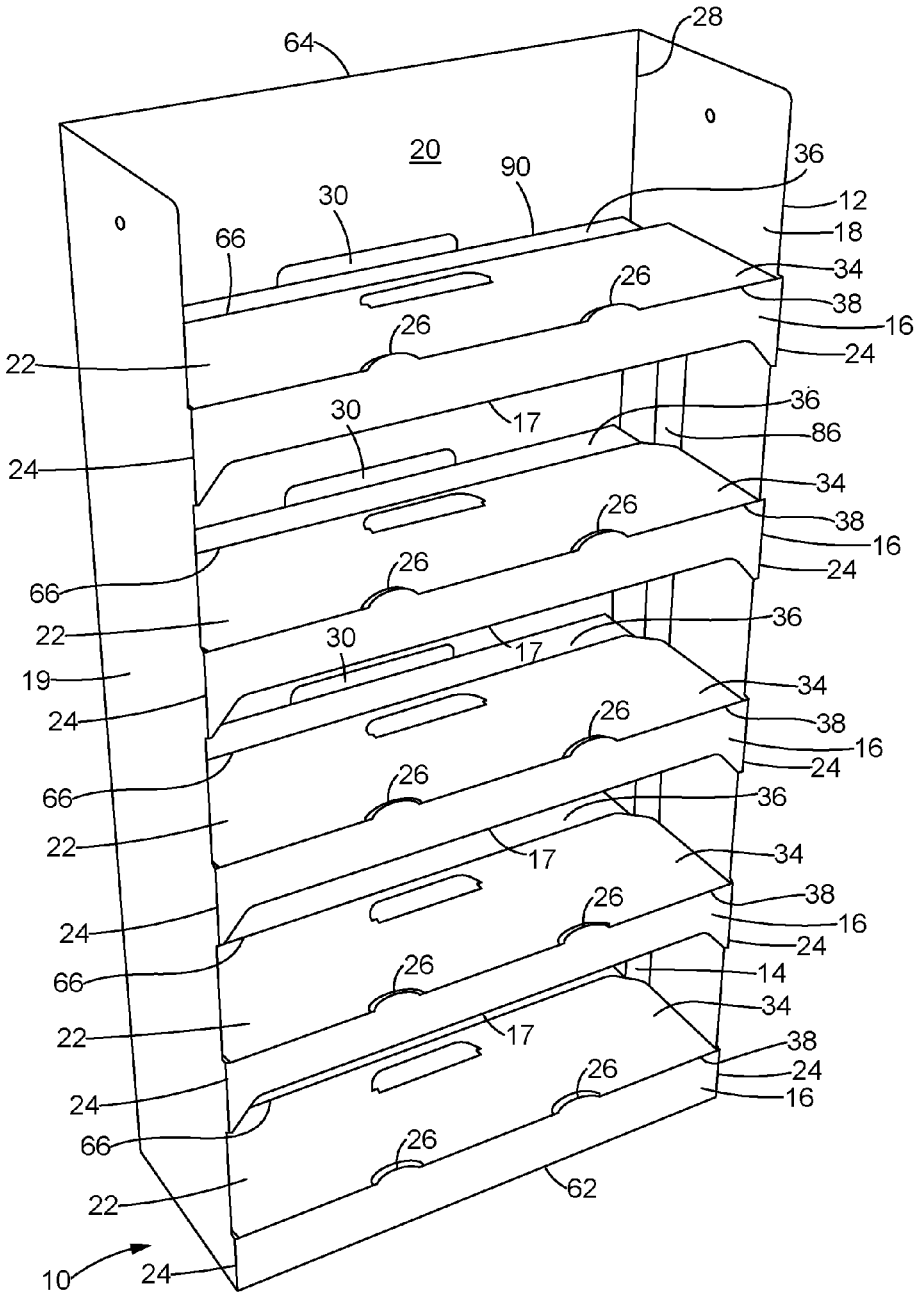
FIG. 1 is a front perspective view of a shelving system according to the disclosure.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

As will be appreciated, terms such as "horizontal," "vertical," "left," "right," "up," "down," "top," "bottom," "front", "back", "rear", "inner", "outer" etc., either used as nouns, adjectives or adverbs (e.g. "horizontally," "upwardly," etc.), refer in this description to the orientation of the structure of the shelving system as it is illustrated in the figures when that figure faces the reader. Such terms are not intended to limit the invention to a particular orientation. The terms "integral", "integrally connected" or "integrally joined" when used to describe the relationship between two or more structures means that the structures are comprised of a single piece of material.

Finally, like structures may be given the same element number in the figures and in different embodiments.

The Shelving System

Referring now to FIG. 1, the disclosure relates to a shelving system 10 comprising two components, an outer structure 12 and an inner structure 14, each made from a single die cut blank. In the assembled shelving system 10 shown in FIG. 1, most or all of the inner structure 14 is positioned within the outer structure 12. The shelving system 10 may be shipped flat from the manufacturer to the user, who can then easily assemble the system 10 before loading it with items.

The assembled shelving system 10 comprises one or more front panels 16, two laterally opposing first and second sidewalls 18, 19, a rear wall 20 and shelves 22. Each shelf 22 comprises two fold-down flaps, one from each component, connected together. The front panels 16, the sidewalls 18, 19, the rear wall 20 and shelf front flaps 34 are integral parts of one component, the outer structure 12. Shelf rear flaps 36 are an integral part of the other component, the inner structure 14. The front panels 16 and sidewalls 18, 19, and even the rear wall 20 and shelves 22, can be adorned with graphics for aesthetic or point of sale advertising purposes.

The front panels 16 extend between and are integrally connected at either end to the two laterally opposing sidewalls 18, 19 along first fold lines 24. Each front panel 16 has a top edge 38 defined by a third fold line 38 and, with the possible exception of the bottommost front panel 16, a free bottom edge 17. Each front panel 16 may comprise one or more tabs 26 extending upwardly from the third fold line 38. The tabs 26 may be used to stabilize packages or products located on the shelf 22.

The first sidewall 18 is hingedly connected to the rear wall 20 along a second fold line 28. The second sidewall 19 is connected to the rear wall 20, such as with adhesive, as explained in more detail below. Alternatively, the second sidewall 19 may be hingedly connected to the rear wall 20 along a fold line and the first sidewall 18 may be connected to the rear wall 20 with adhesive.

The rear wall 20 extends from a bottom edge 62 to a top edge 64 and laterally from one sidewall 18 to the other sidewall 19. The rear wall 20 defines a plurality of slots 30, each of which may be horizontally oriented and configured to receive a portion of a tab 32 extending downward from each shelf 22 as explained in more detail below. Preferably each slot 30 is shaped like an inverted "U" comprising a horizontal portion substantially co-planar with a corresponding third fold line 38 and two downwardly extending legs, each leg terminating at a leg end 31. A horizontal edge 29 of the rear wall 20 defines the lower border of the horizontal portion of each U-shaped slot 30.

The rear wall 20 may comprise a vertical glue flap 48 extending substantially the height of the rear wall 20 and affixed to the rear wall along a fifth fold line 50 opposite the second fold line 28.

Each shelf 22 extends rearward from a third fold line 38 to the rear wall 20, and laterally (side to side) from one sidewall 18 to the opposing sidewall 18. As noted above, each shelf 22 comprises a fold-down front flap 34 and a fold-down rear flap 36 connected together. Together the flaps 34, 36 form the load supporting surface of the shelf 22.

Figure 4:
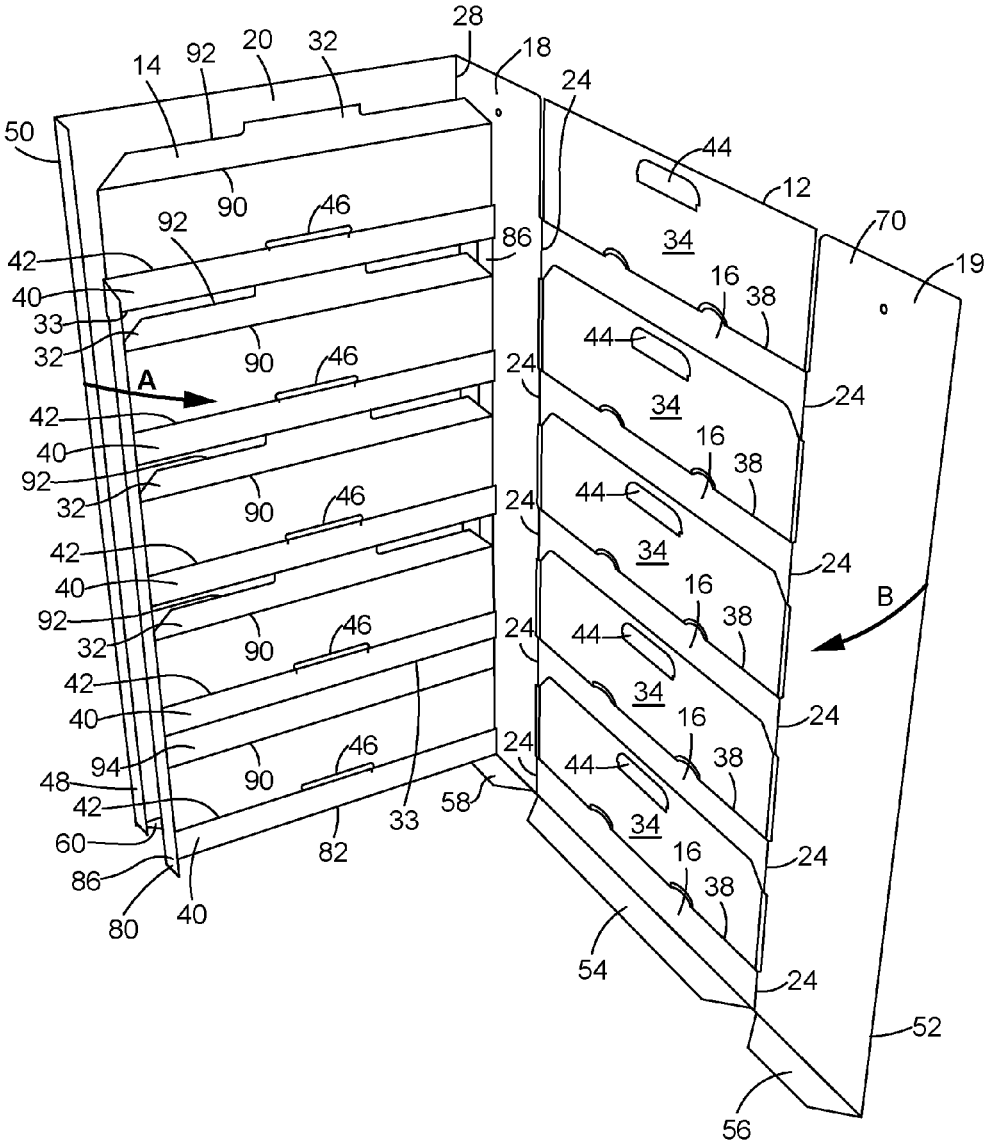
FIGS. 4-10 show how to assemble the shelving system of FIG. 1.

Each front flap 34 is hingedly affixed to a front panel 16 along a third fold line 38. Each rear flap 36 is hingedly affixed to an inner horizontal support panel 40 (obscured in FIG. 1 but shown in FIG. 4) along a fourth fold line 42. Each front flap 34 may be affixed to a corresponding rear flap 36 in any suitable fashion, including by adhesive and/or in tab-in-slot fashion. For example, each front flap 34 may comprise a tab 44 that fits within a slot 46 defined by a corresponding rear flap 36.

The Outer Structure

Figure 2:
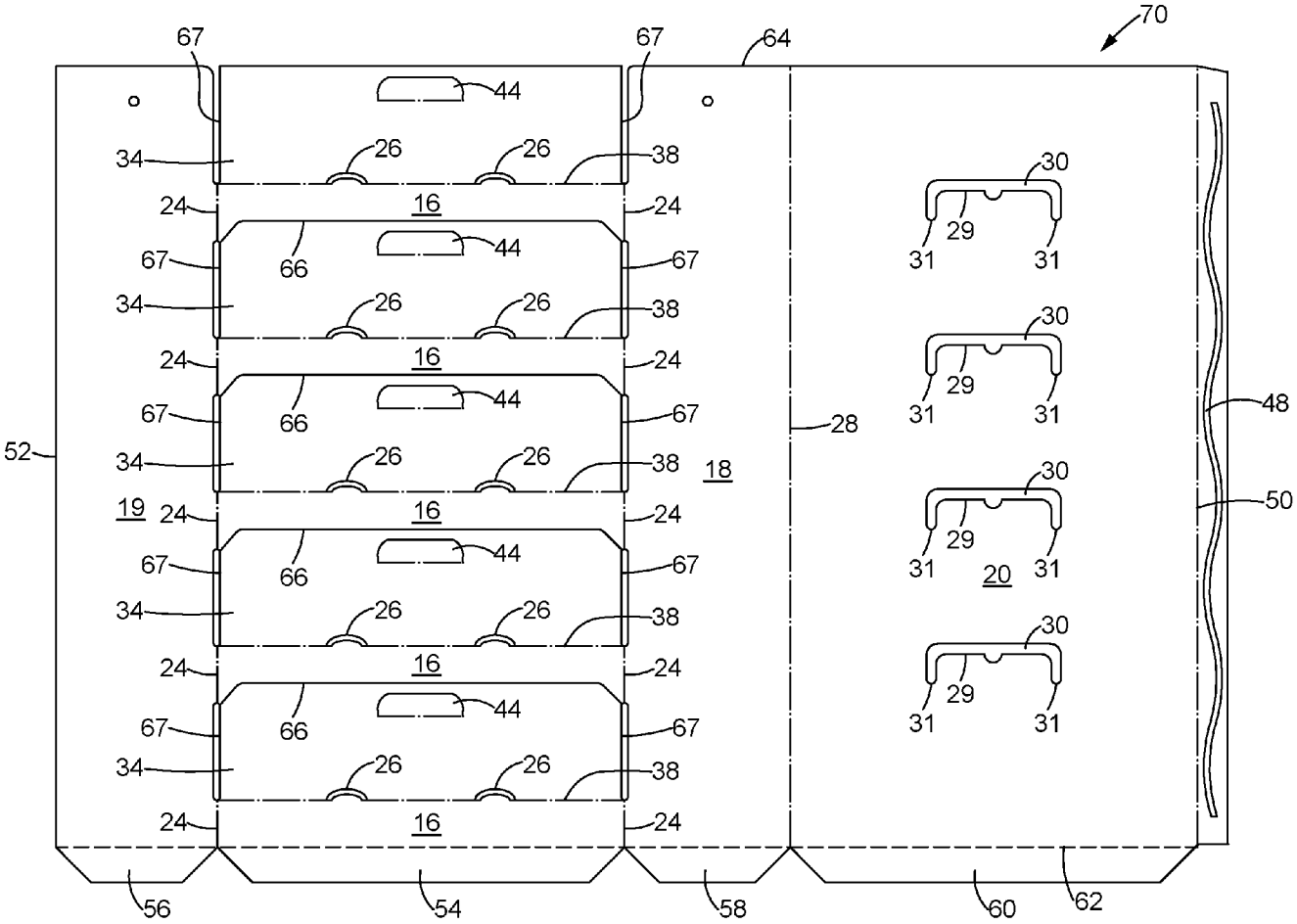
FIG. 2 is a plan view of a first blank used to make the outer structure of the shelving system of FIG. 1.

The outer structure 12 may be made from a first blank 70, like the one shown in FIG. 2, preferably made of corrugated board. Broken lines generally indicate fold lines and solid lines generally indicate a die cut, perforated or scored line, although it should be understood that these lines may be any suitable configuration that allows folding or in some cases, the separation of adjacent panels.

The blank 70 comprises a plurality of laterally elongated front panels 16, two sidewall panels 18, 19, a rear wall panel 20, a plurality of shelf front flaps 34 and a vertical glue flap 48. The sidewall panels 18, 19 and the rear wall panel 20 extend from a bottom edge 62 to a top edge 64.

In the illustrated embodiment the first sidewall 18 is hingedly connected to the rear wall 20 along the second fold line 28 and to the plurality of front panels 16 along co-linear first fold lines 24. The second sidewall 19 is hingedly connected to the plurality of front panels 16 along first fold lines 24 and has a free vertical edge 52 opposite the first fold line 24. In the assembled shelving system 10 the second sidewall 19 is connected to the rear wall 20 by the vertical glue flap 48 as explained below.

Each front panel 16 extends between and is connected at either end to the sidewalls 18, 19 along the first fold lines 24. Substantially horizontal die cuts 66 in the first blank 70 separate the bottom edge 17 of each front panel 16 (FIG. 1) from the rear edge 66 of a shelf front flap 34.

Each shelf front flap 34 may be defined by a third fold line 38 (which also functions as the top edge 38 of each front panel 16), a rear edge 66 and laterally opposing free edges 67. The free edges 67 may be formed by die cutting or other means. Each shelf front flap 34 also comprises a die cut tab 44 located between the third fold line 38 and the rear edge 66 and between the opposing free edges 67.

The rear wall panel 20 extends from the bottom edge 62 to the top edge 64 and from the second fold line 28 and the fifth fold line 50. The rear wall panel 20 may include a vertical glue flap 48 hingedly connected to the rear wall panel 20 along the fifth fold line 50. As noted above this flap 48 may be glued or otherwise affixed to the second sidewall 19 in the assembled shelving system 10. Alternatively, the glue flap 48 may be hingedly connected to the second sidewall 19. The rear wall 20 also defines a plurality of horizontally oriented and vertically arranged slots 30 configured to receive the rear flap shelf tabs 32 during assembly of the shelving system 10.

Bottom flaps 54, 56, 58 and 60 are hingedly attached to the bottommost front panel 16, the two sidewalls 18, 19 and the rear wall panel 20 respectively along the bottom edge 62 of the shelving system 10. The bottom flaps 54, 56, 58 and 60 are designed to be folded inwardly to help stabilize the assembled shelving system 10.

The Inner Structure

Figure 3:
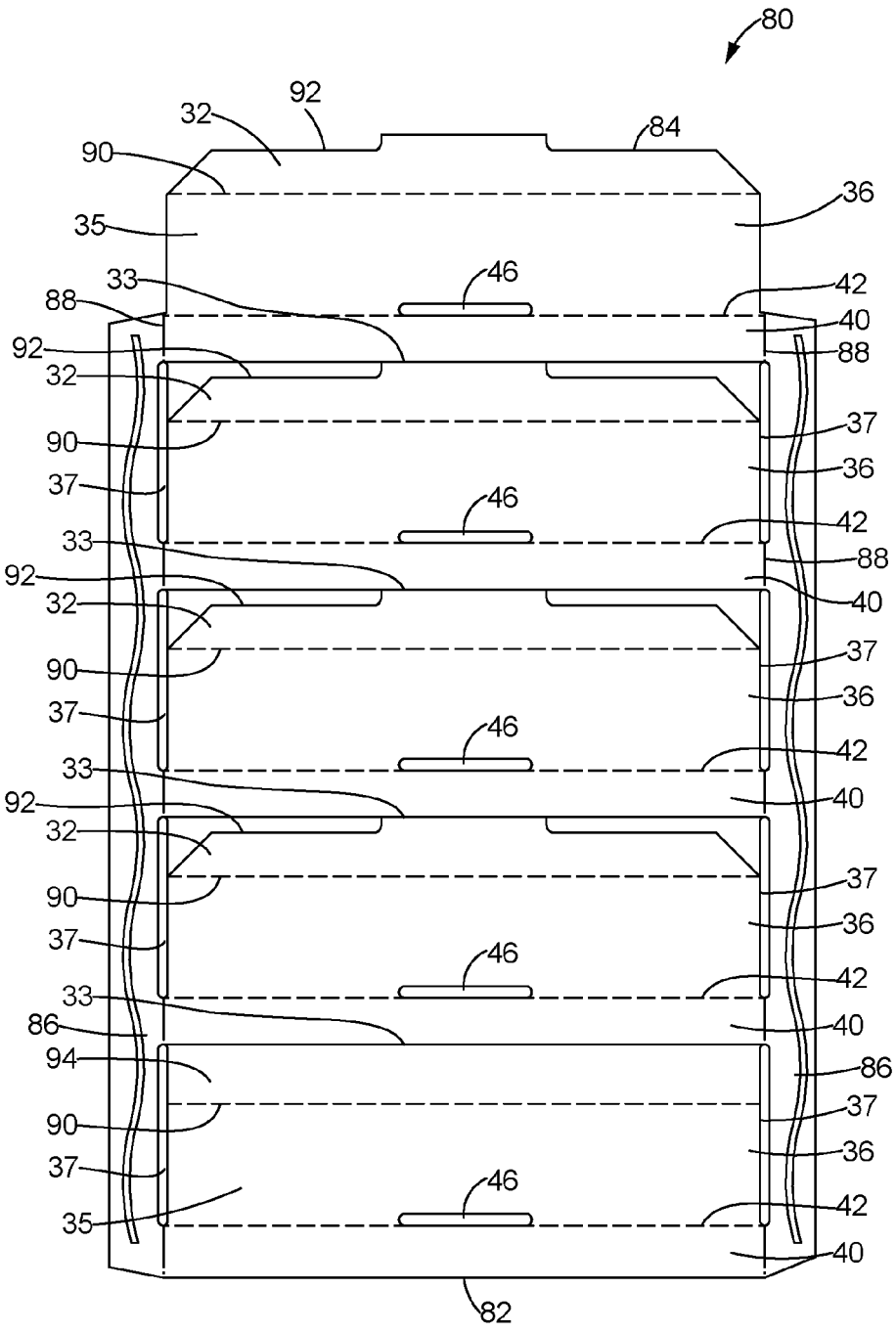
FIG. 3 is a view of a second blank used to make the inner structure of the shelving system of FIG. 1.

The inner structure 14 may be made from a second blank 80, preferably made of corrugated board, like the one shown in FIG. 3. The second blank 80 may extend from a bottom edge 82 to a top edge 84 and comprises a plurality of shelf rear flaps 36, a plurality of laterally elongated inner horizontal support panels 40 and a pair of vertically elongated connecting flaps 86.

Each inner horizontal support panel 40 extends between and is connected at either end to a vertically elongated connecting flap 86 along sixth fold lines 88. A horizontal score line 33 may separate the bottom edge of each horizontal support panel 40 from a shelf rear flap 36. In the assembled shelving structure 10 each horizontal support panel 40 helps support a front flap 34.

Each shelf rear flap 36 comprises a main panel 35 and a shelf tab 32, 94 separated by a seventh fold line 90. Each main panel 35 is hingedly connected to an inner horizontal support panel 40 along a fourth fold line 42. Each shelf rear flap 36 may be defined by the fourth fold line 42 along its front edge, a die cut or otherwise delineated rear edge 92 and laterally opposing free side edges 37. The free side edges 37 may be formed by die cutting or other means.

Each shelf rear flap 36 defines a slot 46 for receiving a tab 44 from a corresponding shelf front flap 34. The slot 46 may be adjacent to the fourth fold line 42.

The vertically elongated connecting flaps 86 are configured to connect the inner structure 14 to the outer structure 12 as explained below.

In the assembled shelving system 10, each shelf tab 32 is configured to cooperate with a corresponding slot 30 in the rear wall 20 to lock each rear flap 36, and thus each shelf 22, in a horizontal, load bearing position. The bottommost shelf tab 94 may be configured so that its free rear edge 33 rests on either a bottom flap 60 or the floor.

Assembly

The shelving system 10 may be assembled as follows:

1. If desired and necessary, pre-break the die cuts or score lines 66 of the first blank 70 below the front panels 16 and pre-break the score lines 33 of the second blank 80 below the inner horizontal support panels 40.

2. Fold in the bottom flaps 54, 56, 58 and 60 of the outer structure 12 to form a base.

3. Adhere the inner structure 14 to the outer structure 12. This may be accomplished by applying glue or other adhesive to the vertical connecting flaps 86 of the inner structure 14 and then adhering one vertical connecting flap 86 to the first sidewall 18 of the outer structure 12 between the front panels 16 and the rear wall 20 and, in one embodiment, about midway between the front and back of the sidewall 18, that is, about midway between the first vertical fold line 24 and the second vertical fold line 28, to obtain the partially assembled structure shown in FIG. 4. The exact location of the second blank 80 with respect to the first blank 70, that is, the exact location of the second blank 80 along the first and second sidewalls 18, 19, will depend on the total depth of the each pair of shelf front flaps 34 and shelf rear flaps 36, since the total depth should equal the distance between the front panels 16 and the rear wall 20.

Figure 5:
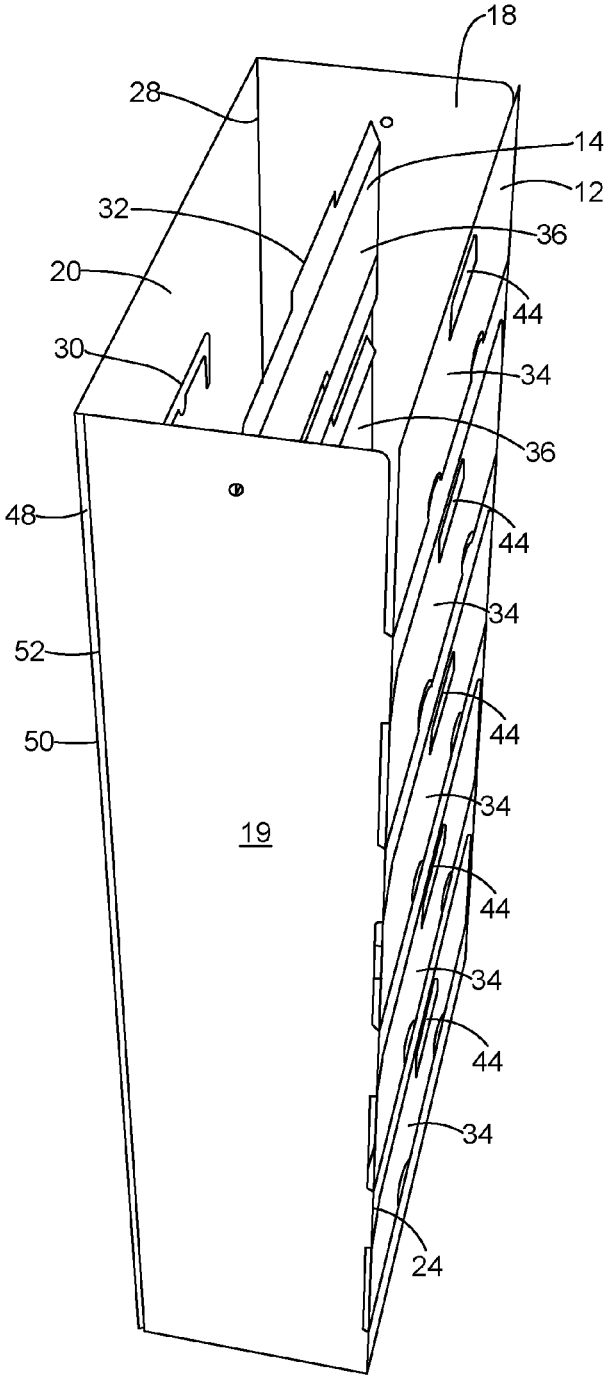
Figure 6:
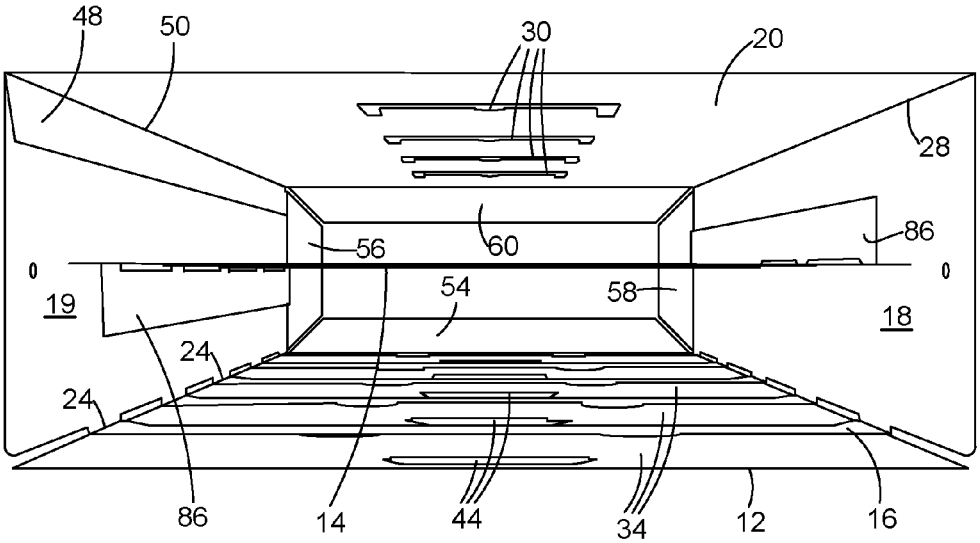

4. Fold the outer structure 12 together as indicted by the arrows (A) and (B) in FIG. 4. More specifically, fold the outer structure 12 along the second fold line 28 as indicated by arrow (A) until the rear wall panel 20 is parallel to ("square with") the front panels 16 and until the flaps 48, 86 are square with the sidewall 18. Then, after glue or other adhesive has been applied to the outer facing surfaces of the glue flaps 48, 86, fold the other sidewall 19 over along first fold lines 24 as indicated by arrow (B) onto the glue flaps 48, 86 and secure the second sidewall 19 to the glue flaps 48, 86 to achieve the structure shown in FIGS. 5 and 6.

5. Fold or rotate each shelf tab 32, 94 along the seventh fold line 90 until the tab 32, 94 is perpendicular to its corresponding main panel 35. For example, if the main panel 35 is vertical, the tab 32, 94 should be horizontal.

6. Beginning preferably at the bottom, fold or rotate downward each shelf rear flap 36 along its fourth fold line 42 toward the rear wall 20. The bottommost shelf rear flap 36 should be rotated until the free rear edge 33 of the shelf tab 94 rests on either a bottom flap 60 extending inward from the rear wall 20 or the floor. Moving upwardly, the other shelf rear flaps 36 should be rotated until each respective shelf tab 32 is securely inserted into a corresponding slot 30 in the rear wall 20. When finished, each of the rear shelf flaps 36, except for perhaps the bottommost rear shelf flap 36, may be supported by the rear wall 20 in three locations: at the locations where the rear shelf flap 32 abuts the two lower ends 31 of each U-shaped slot 30 and along a segment of the seventh fold line 90 where the fold line 90 abuts a horizontal edge 29 of the rear wall 20. In other words, the free rear edge 92 of each shelf rear flap 32 rests on the two leg ends 31 and a portion of the seventh fold line 90 of each shelf rear flap 36 rests on the horizontal edge 29 of the rear wall 20.

Figure 7:
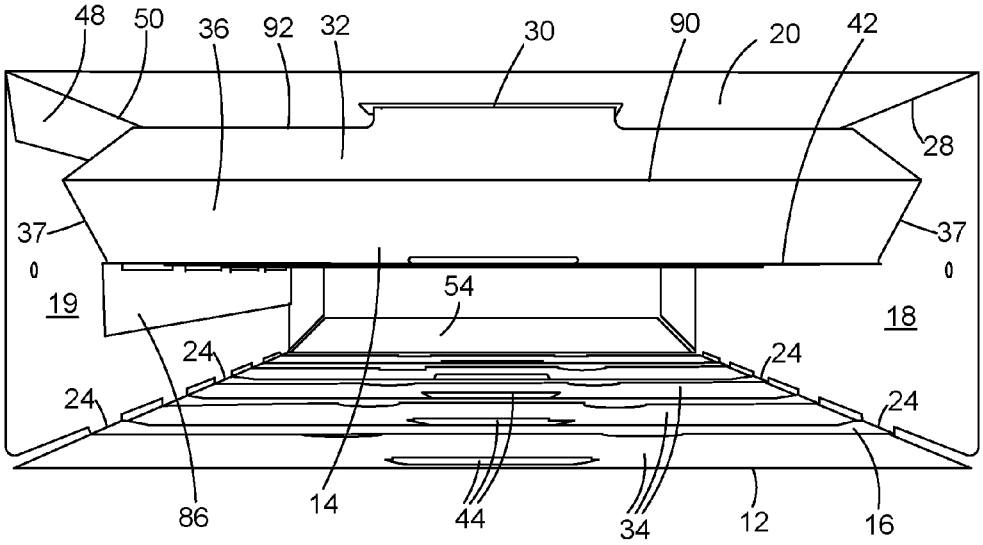
Figure 8:
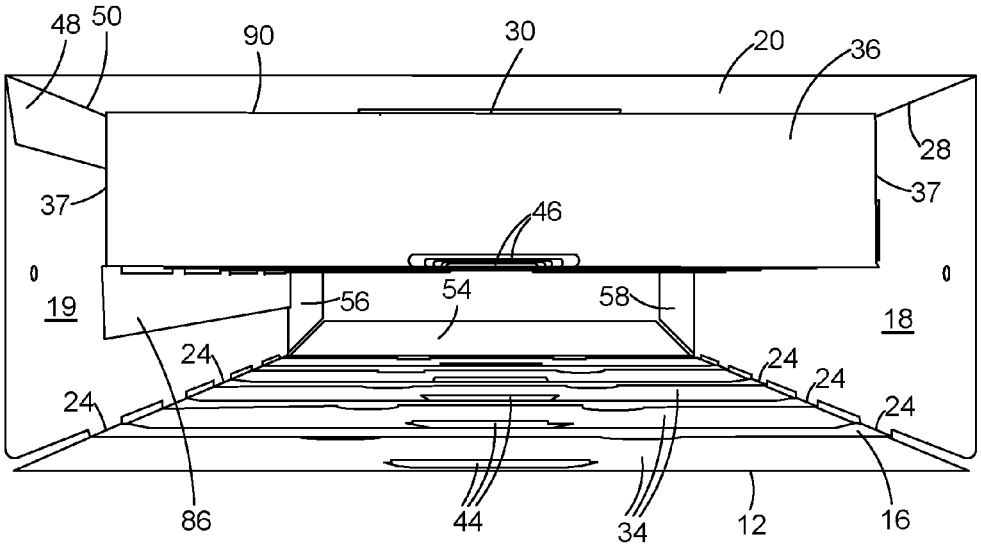
Figure 9:
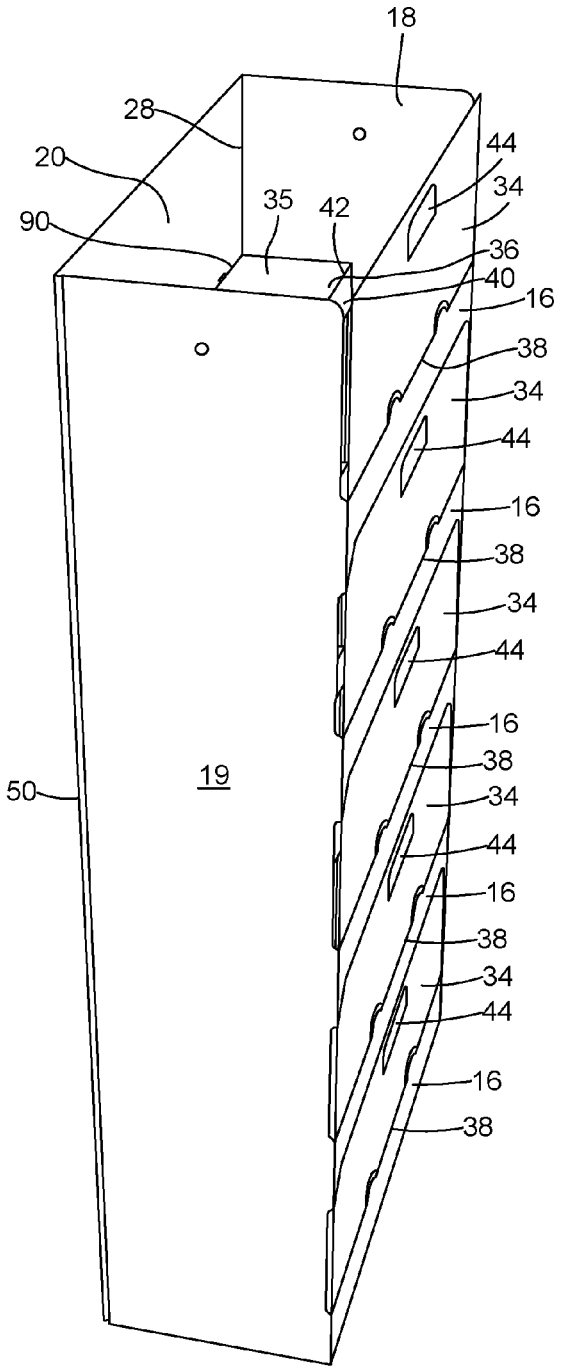

FIG. 7 shows the topmost shelf rear flap 36 being rotated into its final assembled position. FIG. 8 shows the shelving system of FIG. 7 after the topmost shelf rear flap 36 has been rotated into its final assembled position. FIG. 9 is a perspective view of the shelving system of FIG. 8.

Figure 10:
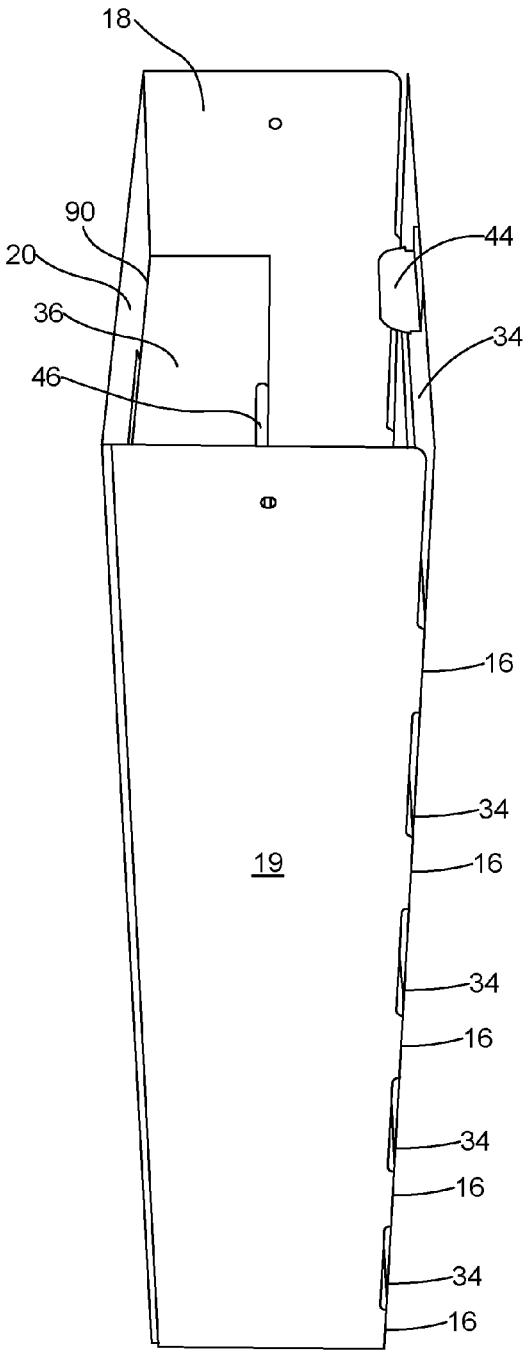

7. If not already done, fold the front flap tabs 44 backwards (inwards). The front flap tabs 44 may be folded until they are perpendicular or almost perpendicular to the shelf front flaps 34 as shown in FIG. 10.

Figure 11:
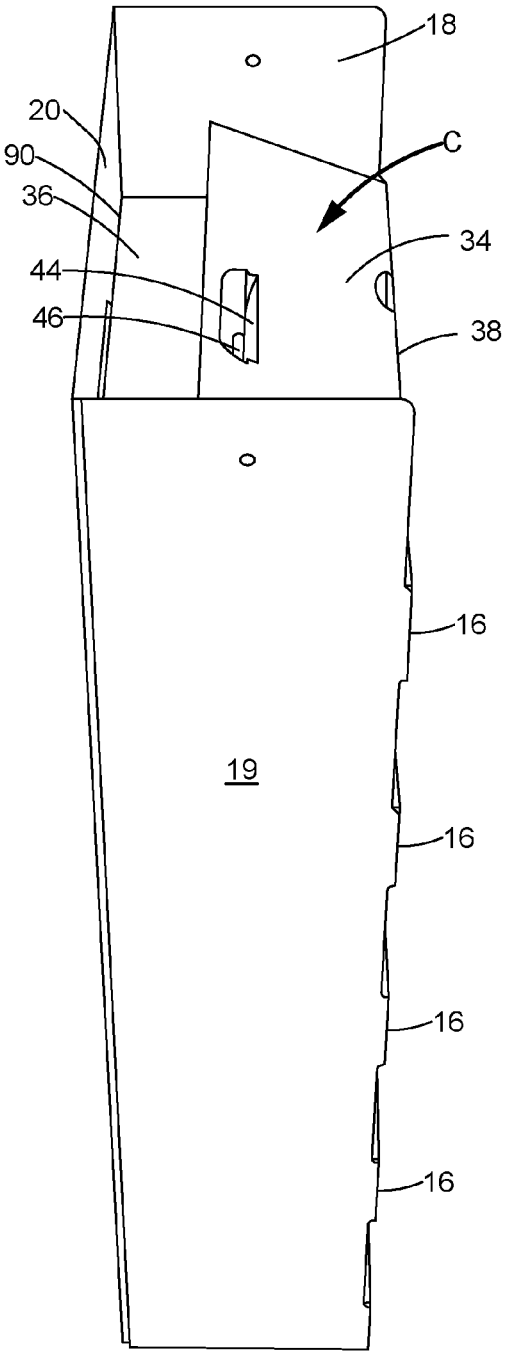
FIG. 11 is a side perspective view of the shelving system of FIG. 10 in a later stage of assembly.

8. As shown in FIG. 11, fold (rotate) each shelf front flap 34 rearwards (inwardly) along a third fold line 38 as indicated by the arrow (C) until the front flap tab 44 is inserted into a corresponding rear flap slot 46 and the shelf front flap 34 is horizontal as shown in FIG. 1. An adhesive may be used to help secure the shelf front flap 34 to the shelf rear flap 36. The shelving system 10 is ready for use.

INDUSTRIAL APPLICABILITY

The shelving system described herein can be used in retail or other settings for the display and sale of any suitable items, including salty snacks, cookies and household goods.

An advantage of the shelving system is that it requires less material than shelving systems that use a double wall of corrugated material for structural stability. Instead, the current system is stabilized by the use of an inner structure. The current shelving system also enables the manufacturer to use different materials for the outer and inner structures. The shelving system also allows flexibility in the number of wall layers used for the outer and inner structures. For example, the manufacturer may also use a single layer of corrugated for the outer structure and a double layer of corrugated for the inner structure.

It should be understood that the embodiments described above are only particular examples which serve to illustrate the principles of the invention. Modifications and alternative embodiments are contemplated which do not depart from the scope of this disclosure as defined by the foregoing teachings and appended claims. It is intended that the claims cover all such modifications and alternative embodiments that fall within their scope.

The invention claimed is:

1. A two component shelving system comprising:

an outer structure comprising:

two laterally opposing first and second sidewalls;

one or more elongated horizontal front panels having laterally opposing ends, each end connected to a sidewall along a first fold line;

a rear wall integrally connected to one of the sidewalls along a second fold line and adhesively connected to the other sidewall, the rear wall defining one or more rear wall slots; and one or more shelf front flaps, each shelf front flap hingedly connected to a front panel along a third fold line, each shelf front flap comprising a tab; and an inner structure comprising:

two vertically elongated connecting flaps adhered to the first and second sidewalls;

one or more elongated inner horizontal support panels having opposing ends connected to the vertically elongated connecting flaps along sixth fold lines; and one or more shelf rear flaps, each shelf rear flap hingedly connected to an elongated inner horizontal support panel along a fourth fold line, each shelf rear flap comprising a tab configured to mate with a corresponding rear wall slot, each shelf rear flap defining a rear flap slot configured to receive the tab of a corresponding shelf front flap.

2. The shelving system of claim 1 wherein:

the outer structure is made from a first unitary blank and the inner structure is made from a second unitary blank.

3. The shelving system of claim 1 wherein:

the front panels, first and second sidewalls, rear wall and shelf front flaps are integral parts of the outer structure; and the shelf rear flaps, inner horizontal support panels and connecting flaps are integral parts of the inner structure.

4. The shelving system of claim 1 wherein:

the outer structure further comprises a rear wall glue flap affixed to the rear wall along a fifth fold line.

5. The shelving system of claim 4 wherein:

the second sidewall is adhered to the rear wall glue flap.

6. The shelving system of claim 1 wherein:

the outer structure and the inner structure are made of corrugated board.

7. A two component shelving system comprising an outer structure made from a first blank and an inner structure made from a second blank; wherein the first blank comprises a plurality of front panels, a first sidewall, a second sidewall, a rear wall, a plurality of shelf front flaps, the front panels are connected to the first sidewall and to the second sidewall along first fold lines; the first sidewall is connected to the rear wall along a second fold line; each shelf front flap is connected to a front panel along a third fold line, each shelf front flap has a rear edge and comprises a die cut tab located between the third fold line and the rear edge, the rear wall defines a plurality of vertically spaced apart rear wall slots; and the second blank comprises a pair of vertically elongated connecting flaps, a plurality of inner horizontal support panels hingedly connected to the vertically elongated connecting flaps along sixth fold lines, and a plurality of shelf rear flaps, each shelf rear flap comprising a main panel and a shelf tab hingedly connected to the main panel along a seventh fold line, each main panel hingedly connected to a corresponding inner horizontal support panel along a fourth fold line, each main panel defining a slot for receiving the die cut tab from a corresponding shelf front flap, each shelf tab configured to cooperate with a corresponding rear wall slot to lock each rear flap in a horizontal, load bearing position.

8. The shelving system of claim 7 wherein:

the first blank further comprises a vertical glue flap affixed to the rear wall along a fifth fold line.

9. The shelving system of claim 8 wherein:

the first sidewall is adhered to one of the connecting flaps of the inner structure; and the second sidewall is adhered to the other connecting flap of the inner structure and to the rear wall glue flap.

10. The shelving system of claim 7 wherein:

the first blank and the second blank are each made of corrugated board.

11. A method of assembling a shelving system comprising the steps of:

providing a first blank comprising a plurality of front panels, a first sidewall, a second sidewall, a rear wall, a plurality of shelf front flaps and a vertical glue flap; the plurality of front panels being connected to the first sidewall along a first set of co-linear first fold lines and to the second sidewall along a second set of co-linear fold first lines, the first sidewall being connected to the rear wall along a second fold line; each shelf front flap being connected to a front panel along a third fold line, each shelf front flap comprising a tab; the vertical glue flap being hingedly connected to the rear wall along a fifth fold line; the rear wall defining a plurality of rear wall slots;

providing a second blank comprising a pair of vertically elongated connecting flaps, a plurality of inner horizontal support panels hingedly connected to the vertically elongated connecting flaps along sixth fold lines, and a plurality of shelf rear flaps hingedly connected to the inner horizontal support panels along a fourth fold line; each shelf rear flap comprises a main panel defining a slot for receiving the tab from a corresponding shelf front flap and a rear flap tab hingedly connected to the main panel along a seventh fold line;

adhering one of the vertically elongated connecting flaps of second blank to the first sidewall of the first blank;

folding the first blank along the first fold lines and the second fold line;

adhering the second sidewall to the glue flap;

rotating each shelf rear flap along a fourth fold line until each rear flap tab is inserted into a corresponding rear wall slot; and rotating each shelf front flap along a third fold line until each front flap tab is inserted into a rear flap slot.

* * * * *